US006283137B1

(12) United States Patent
Malecki

(10) Patent No.: US 6,283,137 B1
(45) Date of Patent: Sep. 4, 2001

(54) SIPHON ASSEMBLY WITH ONE WAY PRIMING VALVE

(76) Inventor: Steven Joseph Malecki, 559 Conway Court, Milton, Ontario (CA), L9T 4B8

( * ) Notice: Subject to any disclaimer, the term of this patent is extended or adjusted under 35 U.S.C. 154(b) by 0 days.

(21) Appl. No.: 09/515,611

(22) Filed: Feb. 29, 2000

Related U.S. Application Data

(60) Provisional application No. 60/122,326, filed on Mar. 1, 1999.

(51) Int. Cl.[7] ..... F04F 10/00

(52) U.S. Cl. ..... 137/1; 137/146; 137/151; 137/850

(58) Field of Search ..... 137/146, 151, 137/850, 1

(56) References Cited

U.S. PATENT DOCUMENTS

| | | | | |
|---|---|---|---|---|
| 962,624 | * | 6/1910 | Cook | 137/151 X |
| 1,336,310 | * | 4/1920 | Marhenke | 137/147 |
| 3,822,720 | | 7/1974 | Souza . | |
| 4,095,615 | | 6/1978 | Ramsauer . | |
| 4,414,997 | | 11/1983 | Jacobson . | |
| 4,797,206 | | 1/1989 | Lynch . | |
| 4,989,760 | | 2/1991 | Songzeng . | |
| 5,044,391 | | 9/1991 | Brumfield . | |
| 5,152,026 | | 10/1992 | Scarpine . | |

FOREIGN PATENT DOCUMENTS

1600743 * 10/1981 (GB) ..... 137/850

* cited by examiner

*Primary Examiner*—Gerald A. Michalsky
(74) *Attorney, Agent, or Firm*—R. Craig Armstrong

(57) ABSTRACT

An improved priming assembly which maybe used for siphoning, includes a siphon tube comprising an inlet end and a discharge end. The discharge end may be connected to a discharge hose that leads to a discharge area. A one-way valve is inserted within the tube adjacent to the inlet end of the tube. The valve comprises a flexible rubber sheath a portion of which is sealed to the inner surface of the tube and which extends toward the discharge end. The sheath is movable from an open position to a closed position. When fluid is caused to flow from the inlet end to the discharge end, the sheath moves to its open position allowing fluid flow. When fluid is caused to flow from the discharge end toward the inlet end, the sheath collapses to the closed position such that it prevents flow of fluid toward the inlet end. Priming of the siphon is created when the sheath collapses into its closed position, under the weight of the fluid as the rigid siphon tube is thrust upwardly. The sheath moves to the open position as the tube moves down within the fluid to be discharged, allowing fluid flow through the valve toward the discharge end, and to accumulate within the tube.

16 Claims, 8 Drawing Sheets

3
12
40
20
38
37
34
35
32
22
30

33
20
3
38
24
22
34
32
40
30
28
12

SIPHON ASSEMBLY WITH ONE WAY PRIMING VALVE

REFERANCE TO RELATED APPLICATION

This is a formal application based on and claiming the benefit of U.S. provisional patent application No. 60/122, 328, fled Mar. 1, 1999.

BACKGROUND OF THE INVENTION

1. Field of the Invention

The present invention relates to a priming assembly including an improved one way valve which allows the rapid flow of large volumes of fluid.

2. Description of the Prior Art

In situations where motorized pumps are not suitable to facilitate the transfer of fluids, it is well known to use a siphon assembly. Typically, siphons include a tube that is used to transfer fluid to a lower level along a path including an intervening portion of relatively higher elevation. Once the fluid in the tube reaches the peak of the elevation, its weight generally provides the impetus to create a continuous flow due to the force of gravity and the elevational difference between the fluid source and the discharge area. The main difficulty presented during siphoning is getting the fluid from the source through the portion of the tube that climbs the elevation. Common methods include sucking on the outlet end of the tube to draw the liquid to the point in the tube where the force of gravity takes over, or dipping a significant portion of the tube into the fluid, filling the tube, then quickly removing the tube from the source and over the elevation where the force of gravity takes over. These methods are not only inconvenient, time-consuming and dangerous but at times impossible, given the volume of fluid to be elevated when sucking or the shape and access to the source container when dipping. Additionally, it is difficult to easily manoeuvre and utilize existing technologies, both motorized pumps and siphons, to vacuum debris from the source container such that the source container is cleaned as it is drained.

It is well known to provide siphon or priming assemblies which include the provision of a one way valve device on the source end of the tube such that the assembly may be shaken in an up and down manner to gradually force the fluid into the siphon tube (commonly referred to as "priming the tube") and up the elevation to the critical point where gravity takes over. In such devices, when the siphon tube is moved in the downward direction during priming, fluid forces the valve member to an unseated position and fluid is allowed into the siphon tube. When the assembly is moved in the upward direction, the valve member is urged into the seated position, preventing the fluid already in the siphon tube from escaping. Continuous up and down movement forces the fluid higher and higher in the siphon tube until it reaches the critical point where the force of the gravity creates continuous siphon flow. Examples of such assemblies are U.S. Pat. No. 4,414,997 to Jacobson et al., U.S. Pat. No. 5,044,391to Brumfield et al. and U.S. Pat. No. 4,989,760 to Songzeng et al.. In these cases, the valve member moves within the flow cavity between its seated position and an unseated position, when the siphon assembly is shaken up and down. When the valve element is in the seated position, fluid is prevented from flowing around it and through the valve body, out of the siphon tube. When the valve element is in the unseated position, fluid is allowed to flow around it and through the valve body into the siphon tube. Once a sufficient amount of fluid has entered the tube, gravity generates continuous siphon flow.

The Jacobson, Brumfield and Songzeng assemblies allow the user to generate siphon flow without the user having to suck on the outlet end of the siphon tube or dipping the tube into the fluid. While these valve assemblies have proven effective in many applications, they do have drawbacks. In particular, when in the unseated position, the valve members disclosed in these patents occupy a substantial amount of the volume within the flow cavity. In addition, the available flow area leading to the siphon tube, as the valve member's are in their unseated position, is limited. These design aspects tend to partially restrict the fluid flow, causing it to slow considerably and making them prone to clogging. An additional drawback of Jacobson's and Brumfield's invention is that neither teaching may allow the user to control and manoeuvre the siphon assembly to vacuum debris from the source container.

U.S. Pat. No. 4,095,615 to Ramsauer et al. attempts to overcome the shortcomings of Jacobson et al., Brumfield et al. and Songzeng et al.. Ranmsauer teaches a complex tubular valve body and flapper valve hingedly disposed within the tubular body so that the flapper valve moves from a position which blocks fluid flow to one where the flapper valve sits substantially flush against the tubular body, allowing for the substantially unimpeded flow of fluid through the valve assembly, greatly improving the efficiency and flow characteristics through the valve. A significant drawback of the valve taught by Ramsauer is the complexity of the valve, and the associated costs involved in designing and developing the various moulds and attachments that would be required to ensure that the hingedly attached valve is operable.

Further technologies have been devised to address the ability to control and manoeuvre a siphon device so that it can be used to vacuum debris suspended within the fluid and that settled on the bottom of it's source container. One such device is described in U.S. Pat. No. 5,152,026 to Scarpine et al. and yet another is described in U.S. Pat. No. 4,797,206 to Lynch at al. Neither of these devices incorporate a priming valve nor have they been designed to siphon large volumes of fluid quickly. In fact, the Lynch technology has been specifically designed to drain a minimal amount of fluid as it is used.

A need is therefore identified for an improved priming assembly and more particularly a manuoverable priming assembly with an improved one way priming valve which functions to efficiently generate continuous siphon flow, which allows for the rapid flow of large volumes of fluid through the valve body and priming assembly, which can be utilized to vacuum debris from the source container and which can be quickly, easily and cheaply made and applied to various sizes or diameters of siphon tube, depending in the volumes of fluid to be transferred, with minimal set-up, tooling and mould development costs.

SUMMARY OF THE INVENTION

It is an object of the present invention to provide a priming assembly including an improved one way priming valve which attempts to overcome the limitations and deficiencies of the prior art.

In particular, an object of the present invention is to provide a one way priming valve for use with a siphon or similar assembly which allows for unrestricted flow of fluid through it for rapid siphon flow and fluid transfer, and which can be made easily and cheaply with minimal set-up, tooling and moulding costs.

Yet a further object of the present invention is to provide a priming assembly that is controllable and manoueverable, affording users the ability to direct the priming assembly to vacuum debris from the fluids source container.

Additional objects, advantages and other novel features of the invention will be set forth in part in the description that follows and in part will become apparent to those skilled in the art upon examination of the following or may be learned with the practice of the invention.

In accordance with an aspect of the present invention there is provided an improved priming assembly comprising a siphon tube including an inlet end, a discharge end, an inner and outer surface. The siphon tube includes a one way valve inserted within the inner surface of the tube adjacent to the inlet end of the tube. The valve comprises a flexible tubular sheath having an inner surface, outer surface. The outer surface of a first portion of said sheath is sealingly engaged to the inner surface of the tube, and a second portion of said sheath extends toward the discharge end. The second portion is movable from an open position to a closed position. In the open position, fluid is allowed to flow from the inlet end and through the interior of the sheath. When fluid is caused to flow from the discharge end toward the inlet end, the sheath collapses to the closed position such that it prevents flow of fluid toward the inlet end.

In accordance with a further aspect of the invention, the siphon tube is rigid and the discharge end may be connected by an attachment joint to a flexible discharge hose that leads to a fluid discharge area.

In accordance with a further aspect of the invention, the valve further comprises a valve body, which is preferably tubular, positioned within the inner surface of the first portion of the sheath and over which the sheath extends. The valve body and inner surface of the first portion of the sheath are sealingly engaged such that fluid may flow through the interior of the valve body toward the second portion. The second portion of the sheath extends beyond the valve body towards the discharge end. Fluid may flow from the inlet end and through the interior of the valve body and second portion, maintaining the second portion in the open position. When fluid is caused to flow from the discharge end toward the inlet end, the second portion collapses to the closed position, preventing flow of fluid toward the inlet end.

Preferably the valve body extends approximately half the length of the rubber sheath. The valve body includes an outlet end cut at an angle preferably at approximately 45 degrees to the length of the tube. The cutting of the outlet end of the rigid tubular valve body at said angle aids in the flexible rubber sheath recovering to its open position from its closed position, providing the flexible rubber sheath the ability to fully recover from each stroke of the priming assembly when priming. Preferably, the valve is inserted into the inlet end of the rigid siphon tube and sealingly fastened accordingly. The seal may be achieved by various means including the use of a ring seal attachment.

Self-priming of the assembly is created when the second portion of the flexible sheath collapses into its closed position, under the weight of the fluid as the rigid siphon tube is thrust up and down within the fluid to be discharged, allowing fluid to accumulate within the tube past the highest elevation point.

In accordance with a further aspect of the invention, the inlet end of the rigid siphon tube may be cut at an angle relative to its length, allowing the siphon tube to be lowered close to the bottom of the fluid container enabling substantially all of the fluid to be drained.

In accordance with yet a further aspect of the invention, a resilient bumper piece having an attachment end and an exposed end, may be sealingly attached to the inlet end allowing fluid to flow through it and into the tube. The exposed end may be angled relative to its length and a valve body may extend from its attachment end. This bumper piece attempts to eliminate the costly and time consuming step of cutting the siphon tube at an angle and attempts to prevent damage to the fluid container.

In accordance with yet a further aspect of the invention, there is provided an attachment joint between the rigid siphon tube and the flexible discharge hose including a means for prevention of the discharge hose from kinking or fatigue. Said means is provided by a reinforcement coil piece of a similar yet smaller diameter than the discharge hose, which is inserted and secured to the flexible discharge hose. The attachment joint may include a cuff extending from the discharge hose which snugly fits over the discharge end of the siphon tube. The coil piece allows the discharge hose to bend as the rigid siphon tube is manoeuvred while under weight from the fluid within the tube while preventing the discharge hose from collapsing or kinking under the weight and which maintains maximum flow dynamics ensuring smooth uninterrupted flow of fluid through the entire priming assembly and discharge hose. This aspect of the invention also minimizes the fatigue on the discharge hose that would otherwise result at the joint.

Yet a further aspect of the invention is that it combines the use of a rigid siphon tube with a flexible discharge hose providing the user the ability to direct the fluid being discharged from the source container to a specific destination, either a discharge area or a container. This aspect coupled with the clogless capabilities provided by the priming valve provide the user with the ability to use this priming assembly not only to drain fluid from its source container but to vacuum debris from the source container as well.

Another aspect of this invention is that the distal end of the discharge hose is designed such that additional lengths of discharge hose can be added to it, providing the user with the ability to direct the fluid to a discharge area or container that is a further distance away from the fluid source.

An advantage of the present invention is that it provides an assembly including a one way priming valve that has a minimum number of components, is easy and economical to make and use, can be easily adapted to various diameters of tube and requires significantly less initial investment in tooling, moulds and similar initial start-up costs than that seen in the prior art. A further advantage provided by this invention is that the priming valve allows siphon flow to be created by manipulation of the assembly from a position remote from the fluid, eliminating the hazards associated with the contact and possible swallowing of a dangerous fluid and which provides a valve which minimizes the restriction of fluid flow in its open position.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

Reference will now be made in detail to the present preferred embodiment of the invention, an example which is illustrated in the accompanying drawings.

DETAILED DESCRIPTION OF THE PREFERRED EMBODIMENT

Figure 1:
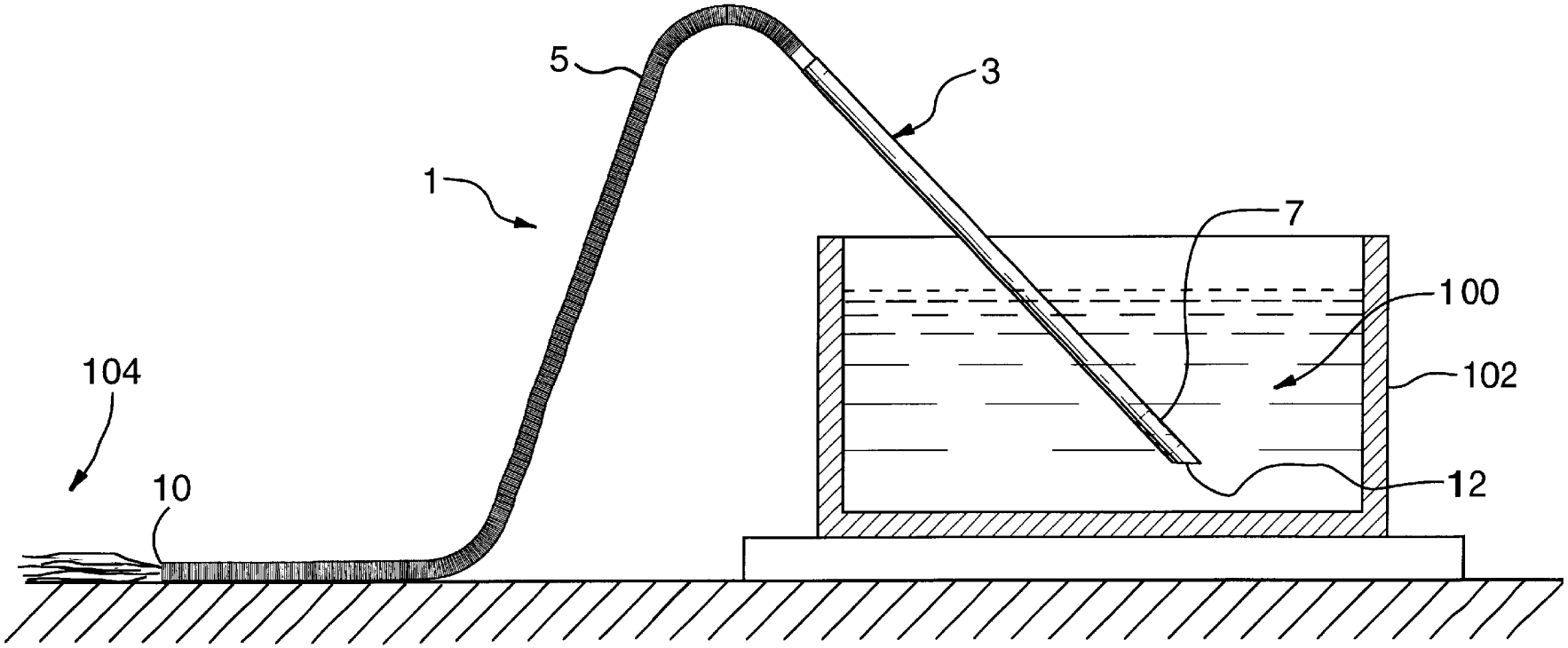
FIG. 1 is a side elevation view of the preferred embodiment of the invention, siphoning fluid from a fluid container to a discharge area.
Figure 2:
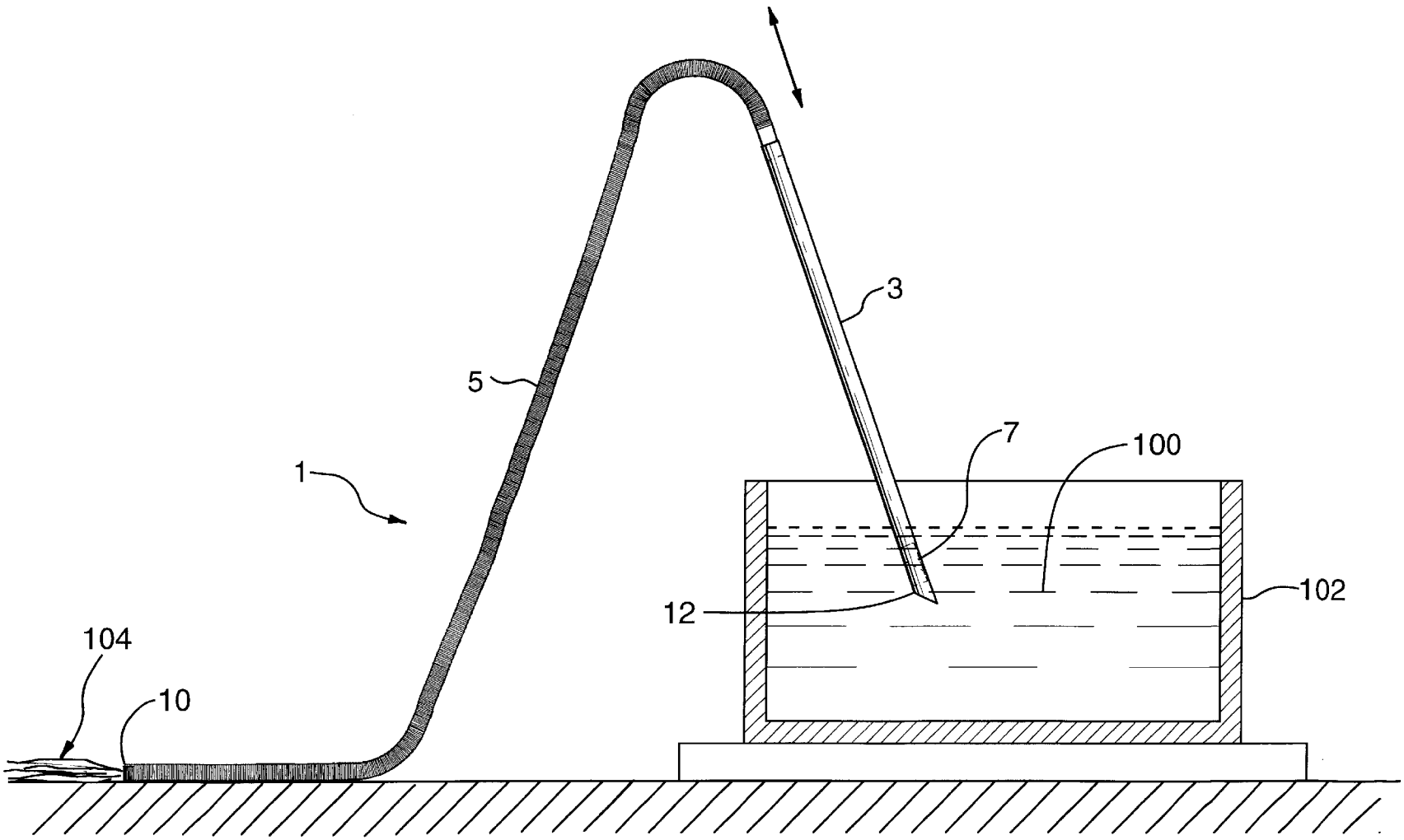
FIG. 2 is a side elevation view of the preferred embodiment of the invention siphoning fluid from a fluid container to a discharge area, showing the priming of the tube by up and down movement.

As shown in FIGS. 1 and 2, the preferred embodiment of priming assembly 1 is shown in the working environment. The priming assembly 1 of the present invention is particularly beneficial in transferring fluids 100 from a container 102, to a discharge area 104 or another container at a lower elevation (not shown). As shown in FIG. 2, siphoning action may be established by continuous reciprocation of the assembly 1, from an upper position to a lower position, thereby eliminating any need for an individual to suck on the end of the discharge hose or the dipping a significant portion of the assembly into the fluid.

The preferred embodiment of the priming assembly I includes a siphon tube 3, flexible discharge hose 5, and a priming valve 7. The valve 7 is attached adjacent to the inlet end 12 of the rigid siphon tube 3. The siphon assembly 1 acts to transfer the fluid 100 from the source container 102 to a fluid discharge area 104 or discharge container (not shown).

The second end 10 of the discharge hose 5 has been designed such that additional sections of discharge hose can be easily attached using a common hose coupler allowing for greater flexibility and increased options in determine the location of the discharge area 104 or container.

Preferably, the inlet end 12 of the rigid siphon tube 3 is cut at a 45 degree angle, allowing the siphon tube 3 to be lowered close to the bottom of the fluid container 102 during the siphoning enabling substantially all of the fluid 100 to be drained.

Figures 3, 4:
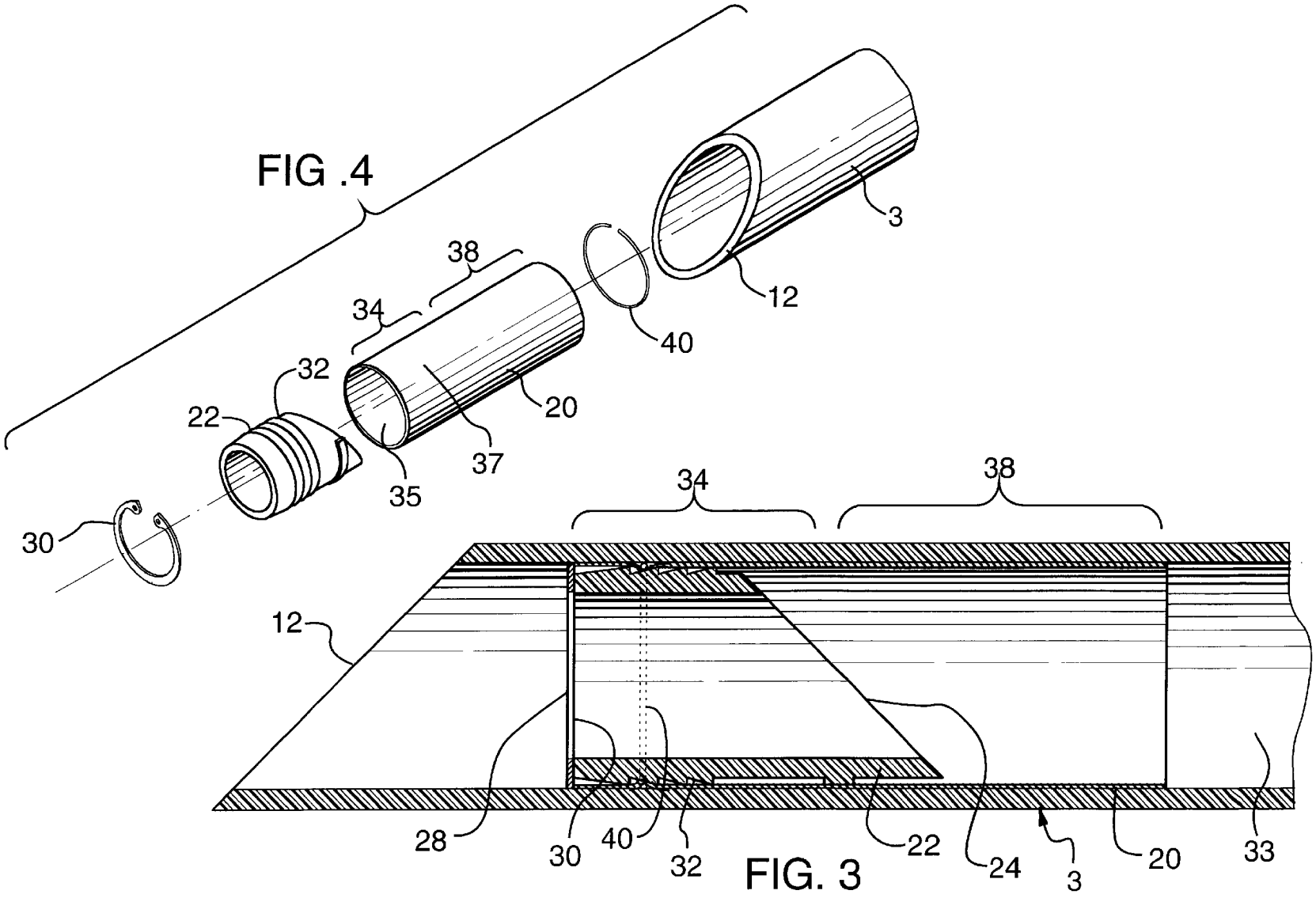
FIG. 3 is a side sectional view of the valve of the preferred embodiment in its open position.
FIG. 4 is an exploded view of the valve of the preferred embodiment being inserted into inlet end of the siphon tube.

FIGS. 3 and 4 show the one way valve 7 of the preferred embodiment in detail. The valve comprises a flexible tubular sheath 20, having an inner 35 and outer surface 37 and including a first portion 34 and a second portion 38, stretched over a rigid tubular valve body 22, which includes a throughbore extending therethrough, positioned adjacent to the inlet end 12 of the siphon tube. The tubular valve body 22 is preferably a similar yet smaller outside diameter than the inner surface 33 of the rigid siphon tube 3, such that once the flexible rubber sheath 20 is stretched over it, it fits snugly within the rigid siphon tube 3 allowing it to be inserted and maneuvered into position and fastened appropriately.

In the preferred embodiment, the first portion of the sheath 34 and valve body 22 are fastened into position adjacent to the inlet end 12 of the rigid siphon tube 3 such that the inlet end of the one way valve 28 is completely within the rigid siphon tube 3 clear of the angled inlet end 12 of the siphon tube.

The components of the one way valve 7 are tubular in nature slightly smaller in diameter than the inner surface of the rigid siphon tube 3 itself. As a result fluid 100 is allowed to freely flow through the one way valve 7 unobstructed, maximizing the volume of fluid that can flow through it while providing its clogless characteristics. The one way valve 7 as described in this invention eliminates the poor flow characteristics and clogging issues created when the fluid must travel around the valve seat devices such as ball or other pieces described in prior art.

Figure 6:
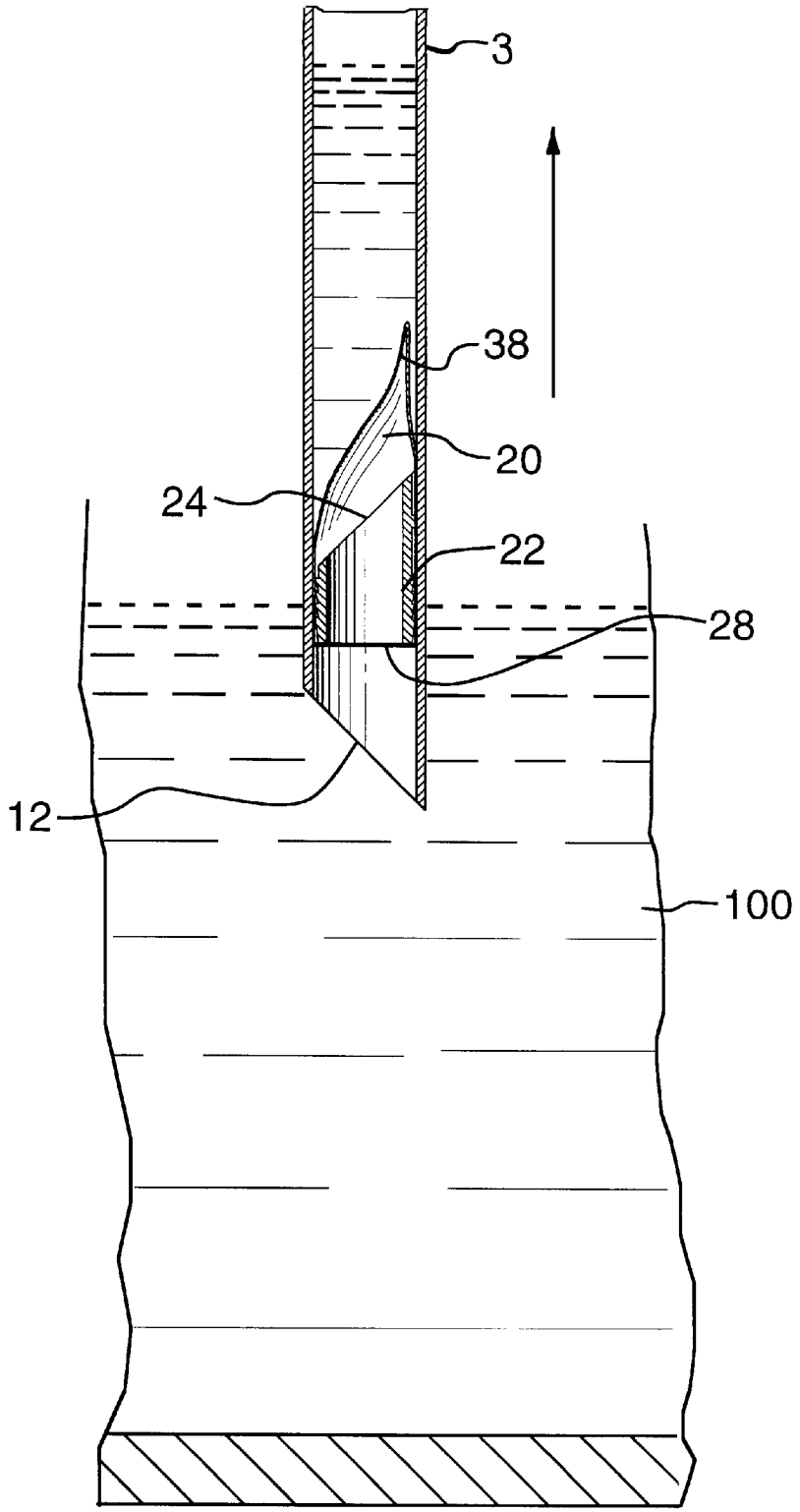
FIG. 6 is a side section view of the preferred embodiment showing the valve in its closed position.

Preferably the outlet end 24 of the tubular valve body 22 is cut at an angle. The angle prevents the flexible rubber sheath 20 from collapsing into the rigid tubular valve body 22 during priming and plugging the siphon assembly. The angle prevents this by guiding the flexible rubber sheath 20 to collapse sideways against the rigid siphon tube 3 and then against the outlet end 24 of the valve body as the siphon assembly 1 is primed (as is seen in FIG. 6). This ensures that the flexible rubber sheath 20 recovers from every priming stroke, enhancing functionality. The first portion of the sheath 34 and tubular valve body are sealed to the inner surface of the siphon tube at the inlet end by means of a ring seal 30, as shown in FIGS. 3 and 4. The valve body may include ribs 32 on its outer surface further fixing the valve body to the inner surface of the sheath within the tube. The sheath is further fixed in place by a compression ring 40 fitting snugly around the first portion of the sheath and compressing the sheath into a rib 32 of the valve body.

Figure 5:
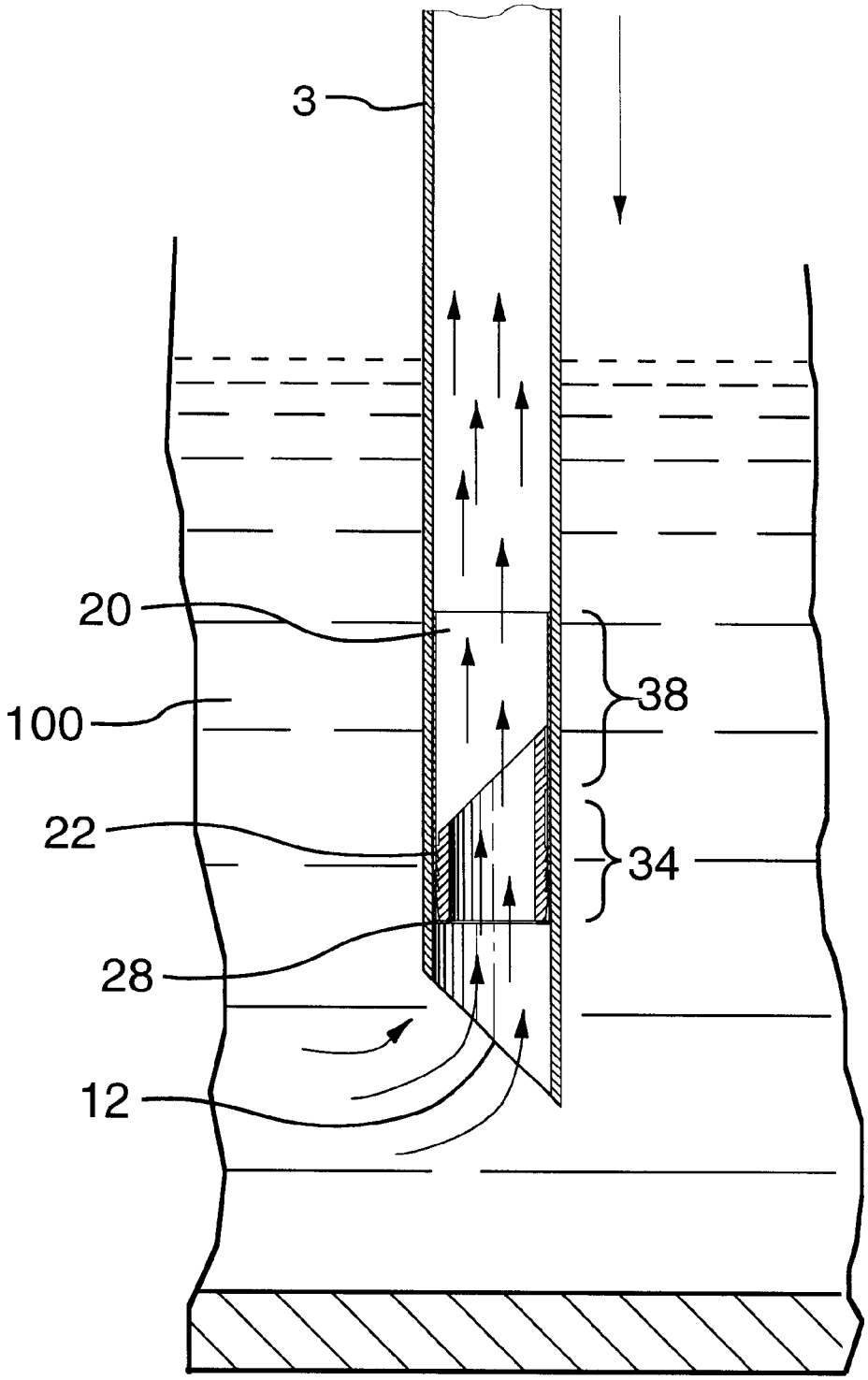
FIG. 5 is a side section view of the preferred embodiment showing the valve in its open position.

As shown in FIGS. 5 and 6 in operation, the rigid siphon tube 3 containing the one way valve 7, including the tubular valve body 22, the flexible sheath 20 and the ring seal 30, is inserted in the fluid 100 of the fluid source 102. The fluid 100 must generally travel up an elevation to a maximum point before turning downward to flow to the fluid discharge area 104 at a lower elevation than the fluid source 102. In order to force the fluid 100 up the elevation, the rigid siphon tube 3 containing the priming valve 7 is shaken up and down to incrementally force the fluid 100 up the siphon tube 3. This up and down shaking motion defines the priming action of the siphon assembly 1. As shown in FIG. 5, as the rigid siphon tube 3 containing the one way valve 7 is moved downwardly, fluid 100 is forced through the one way valve 7 into the rigid siphon tube 3. Thus, an additional volume of fluid 100 enters the siphon tube 3 during each downward motion of the priming action.

As shown in FIG. 6 as the siphon tube 3 containing the one way valve 7 is moved upwardly during priming, the second portion of the flexible rubber sheath 38 collapses sideways against the rigid siphon tube 3 and valve body 22 preventing the fluid 100 within the tube 3 from escaping. Thus, as the rigid siphon tube 3 is continuously shaken, the fluid 100 incrementally is drawn up the elevation of the tube 3 until it reaches the apex position of the discharge hose. As the fluid passes this point, it is drawn naturally into the discharge area 104 by the force of gravity. Once this occurs, continuous siphon flow is generated and no further shaking of the rigid siphon tube 3 is required. Because one way valve provides virtually no impediment to fluid flow, and because the siphon tube may be easily moved to various positions within the fluid source, this siphon assembly may also be used to vacuum debris from the fluid source.

Figure 7:
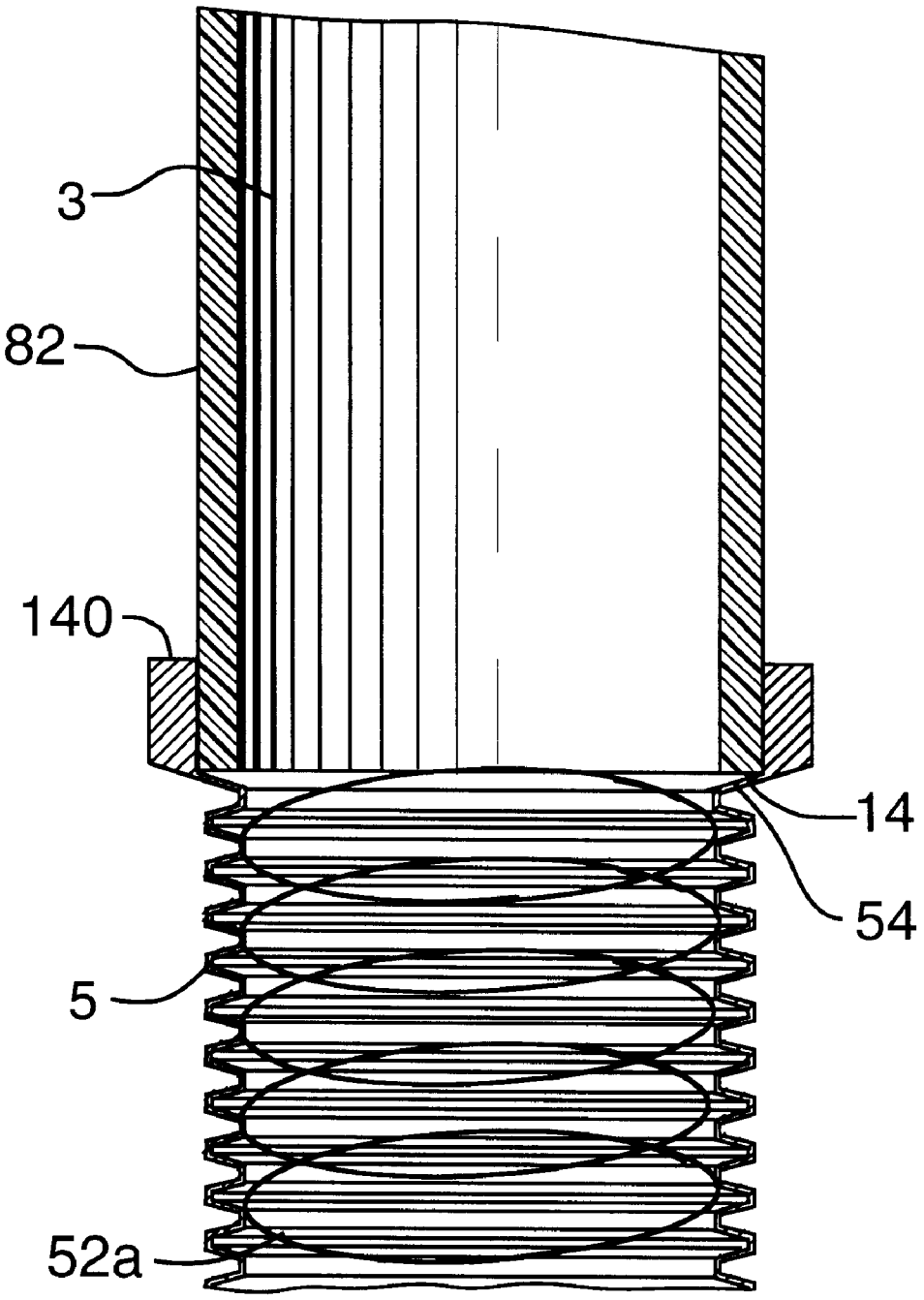
FIG. 7 is a side section view of the joint between the rigid siphon tube and the flexible discharge hose of the preferred embodiment.

Shown in FIG. 7 is the joint attaching the flexible discharge hose 5 to the rigid siphon tube 3 at the tube's discharge end 14. A reinforcement means, preferably a coil piece 52*a* is inserted and secured in the first end 54 of the discharge hose. This embodiment also may include a resilient cuff 140, extending from the first end 54 of the discharge hose, said cuff having an inner circumference slightly larger than that of the outer surface 82 of the tube 3. In this embodiment, the attachment joint is secured together simply by inserting the discharge end 14 of the tube in the cuff 140, creating a sealing engagement, which may be reinforced with an appropriate adhesive, such as cement.

Figure 7A:
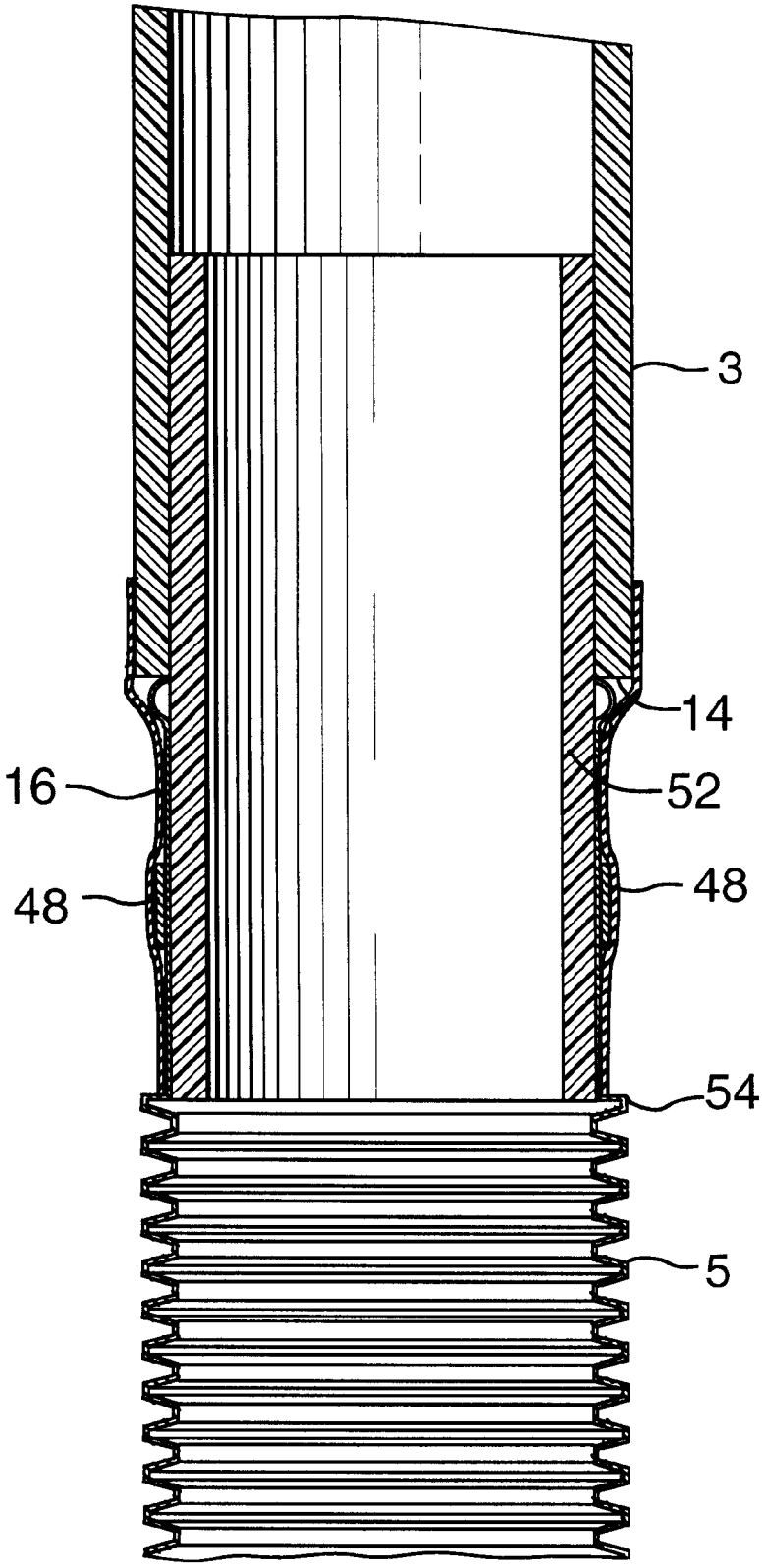
FIG. 7*a* is a side section view of the joint between the siphon tube and discharge hose of an alternate embodiment.

As shown in FIG. 7*a* in an alternate embodiment, a hose adapter 52 is partially inserted within the rigid siphon tube 3 and is sealed within the tube by means of an appropriate adhesive. A portion of the hose adapter 52 extends out of the tube 3. The first end 54 of the hose 5 is then inserted over the portion of the hose adapter extending out of the tube. At least one clamp 48 may be included in order to fix the hose in place. Preferably, a rubber sheath 16 extends over the joint to ensure that the joint is protected and sealed.

Figure 8:
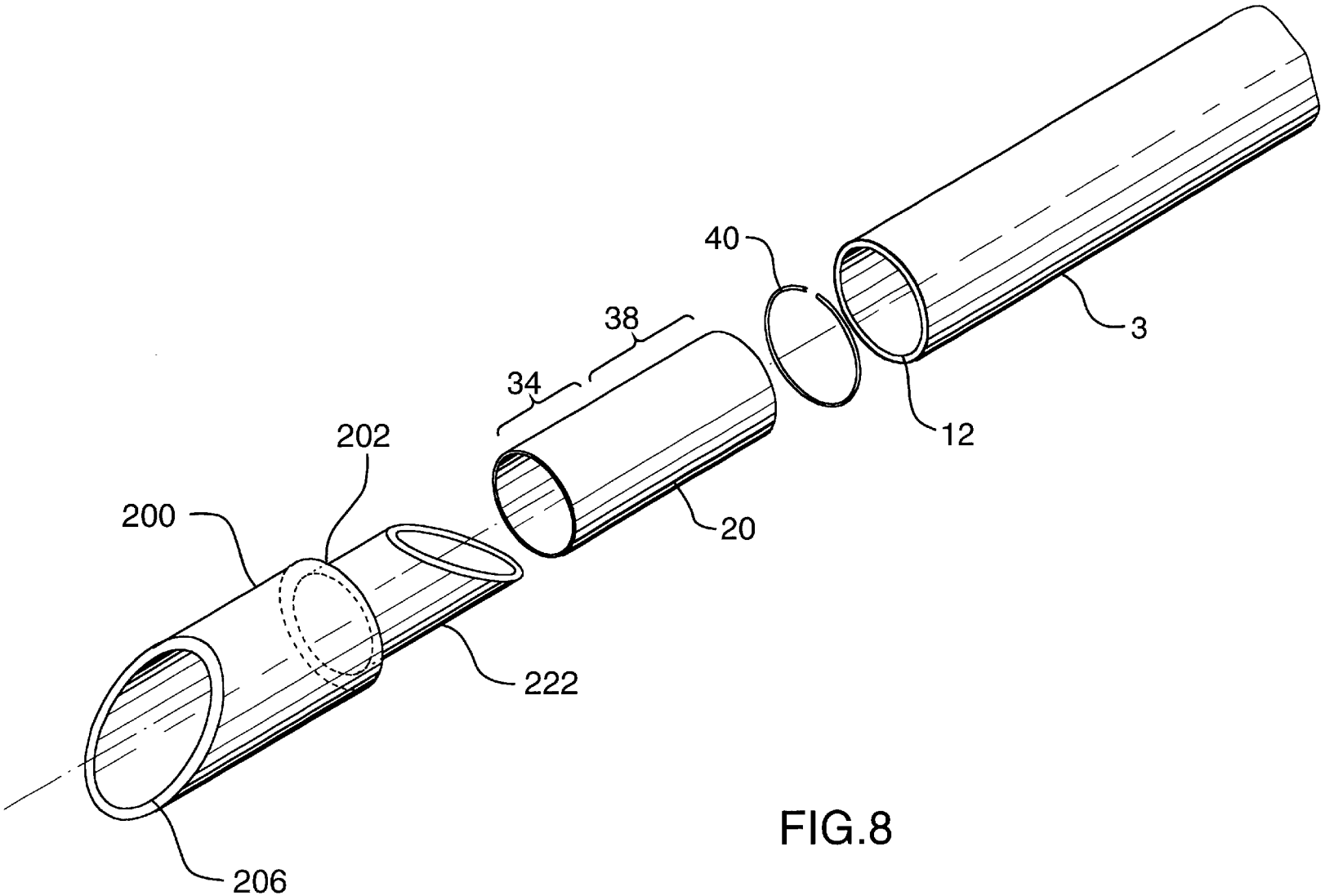
FIG. 8 is a perspective view of the inlet end of an alternate embodiment showing a bumper piece with valve body insertable in the inlet end.

Shown in FIG. 8, an alternate embodiment further includes a resilient bumper piece 200 including an opening extending from its attachment end 202 to an exposed end 206. The attachment may be sealingly engaged to the inlet end 12 of a siphon tube which in this embodiment is cut straight across rather than at an angle. Once attached to the inlet end 12 fluid may flow through said bumper piece into said tube. The exposed end is angled, preferably at approximately 45 degrees, allowing the assembly to be lowered close to the bottom of the fluid container during the siphoning, enabling substantially all of the fluid to be drained. In this alternate embodiment, a valve body 222 is attached to the attachment end 202 extending distally therefrom, such that when the bumper piece is attached to the inlet end, the valve body is positioned within the tube in sealing engagement with the interior of the first portion 34 of the sheath 20. The bumper piece may be made of rubber or other suitably resilient material so as to eliminate any damage to the fluid container.

In summary, the use of a substantially tubular one way valve 7 assists in providing smooth, rapid siphon flow of large volumes of fluid into and through the priming assembly 1. The angle of the tubular valve body at its discharge end 24 ensures that the flexible rubber sheath 20 fully recovers from each priming stroke. The preferred 45 degree angle at the inlet end 12 of the siphon tube 3 or of the bumper piece 200 ensures that the fluid source 102 can be completely drained, while means to prevent the discharge hose 5 from kinking and fatiguing at the attachment joint is also provided. Accordingly, the user can easily and efficiently generate siphon flow using the one way valve 7 and utilizing the priming assembly 1 to quickly drain and vacuum clean a fluid source 102.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, the inlet end of the siphon tube may include a flexible attachment which would allow a vacuum lead to be attached and used with the invention. The valve body and sheath may be attached to the siphon tube by any suitable means such as grommets. The outlet end of the discharge hose may be adapted such that additional sections of discharge hose can be easily attached using a common hose coupler allowing for greater flexibility and increased options in determining the location of the discharge area. Although, the priming assembly is described for use to evacuate fluid from a container, it may be used for other means. For example, in many pool vacuum systems, it is necessary to fill the vacuum hose with fluid prior to commencing vacuuming of the pool. The invention described herein, namely the priming assembly with one way valve may be used to self prime a pool vacuum hose, forcing fluid into a pool vacuum hose, prior to vacuuming rather than having to immerse the vacuum hose completely in water.

What is claimed as the invention is:

1. A priming assembly comprising:

an elongated siphon tube having an inlet end, discharge end, inner surface, outer surface and a length defined as the distance between its said ends;

a one-way valve positioned within said tube adjacent to said inlet and; said valve comprising a flexible tubular sheath having an inner surface and outer surface; said outer surface of a first portion of said tube being sealed around the entire circumference of the inner surface of said tube, and a second portion of said tube extending toward said discharge end from said first portion; said second portion being collapsable from an open position to a closed position, such that in said open position, fluid and debris are allowed to flow through the interior of said sheath from said inlet end towards said discharge end and such that in said closed position said second portion collapses, preventing the flow of fluid and debris from said dicharge end to said inlet end, and wherein said valve body includes an outlet end which is cut at an angle relative to the length of said tube, whereby said second portion is guided to collapse from said open to said closed position toward one side of said tube.

2. A priming assembly as recited in claim 1 further comprising a flexible discharge hose having a first end detachably secured to said discharge end so as to define an attachment joint, and including a second end for positioning adjacent to a discharge area.

3. A priming assembly as recited in claim 2 wherein a portion of said discharge hose adjacent to said first end is reinforced by a coil piece extending within and being secured to said tube.

4. A priming assembly as recited in claim 2 wherein said discharge hose includes a resilient cuff piece extending distally from said first end shaped and sized such that said discharge end fits snugly within said cuff piece so as to seal said attachment joint.

5. A priming assembly as recited in claim 1 wherein said one way valve further comprises a valve body positioned within said sheath and being sealed to the inner surface of said first portion and extending to said second portion; said second portion extending toward said discharge end further than said valve body so as to allow said second portion to collapse from said open to said closed position.

6. A priming assembly as recited in claim 5 wherein said valve body is tubular, including a throughbore extending therethrough, such that fluid may flow through said throughbore.

7. A priming assembly as recited in claim 5 wherein said sheath extends toward said discharge end beyond said valve body by the same approximate length as the valve body; the length of said valve defined as the distance from its end adjacent said inlet end to its said outlet end.

8. A priming assembly as recited in claim 5 wherein said sheath and valve body and tube are sealed by means of a compression ring.

9. A priming assembly as recited in claim 5 further comprising a resilient bumper piece including an opening extending from an attachment end to an exposed end, said attachment end being sealingly engaged to said inlet end such that fluid may flow through said bumper piece into said tube.

10. A priming assembly as recited in claim 9 wherein said exposed end is angled at approximately 45 degrees.

11. A priming assembly as recited in claim 9 wherein said valve body is attached to said attachment end.

12. A priming assembly as recited in claim 1 wherein said angle is approximately 45degrees.

13. A priming assembly as recited in claim 1 wherein said sheath and tube are sealed by means of a ring seal attachment.

14. A priming assembly as recited in claim 1 wherein said inlet end is cut at an angle relative to the length of the tube.

15. A priming assembly as recited in claim 14 wherein said angle is approximately 45 degrees.

16. A method of utilizing a priming assembly comprising:

an elongated siphon tube having an inlet end, discharge end, inner surface, outer surface and a length defined as the distance between its said ends;

a one-way valve positioned within said tube adjacent to said inlet end; said valve comprising a flexible tubular sheath having an inner surface and outer surface; said outer surface of a first portion of said tube being sealed around the entire circumference of the inner surface of said tube, and a second portion of said tube extending toward said discharge and from said first portion; said second portion being collapsable from an open position to a closed position, such that in said open position, fluid and debris are allowed to flow through the interior of said sheath from said inlet end towards said discharge end and such that in said closed position said second portion collapses, preventing the flow of fluid and debris from said discharge end to said inlet end, and wherein said valve body includes an outlet end which is cut at an angle relative to the length of said tube, whereby said second portion is guided to collapse from said open to said closed position toward one side of said tube, said method comprising the steps of:

immersing said inlet end in fluid;

reciprocating said tube in a direction parallel to the length of said tube;

whereby said fluid is forced to enter into the interior of said tube and flow from said inlet end through said valve toward said discharge end, being forced toward the discharge end upon continuous said reciprocating.

* * * * *